US009527001B2

(12) United States Patent
Richardson et al.

(10) Patent No.: US 9,527,001 B2
(45) Date of Patent: Dec. 27, 2016

(54) BED TOY AND SLEEP TIME INDICATOR

(71) Applicant: Purple Pancakes LLC, Cincinnati, OH (US)

(72) Inventors: Anna Michelle Richardson, Cincinnati, OH (US); Meghan Kathleen Hunley, Cincinnati, OH (US)

(73) Assignee: PURPLE PANCAKES, LLC, Cincinnati, OH (US)

( * ) Notice: Subject to any disclaimer, the term of this patent is extended or adjusted under 35 U.S.C. 154(b) by 0 days.

(21) Appl. No.: 14/602,530

(22) Filed: Jan. 22, 2015

(65) Prior Publication Data

US 2015/0224417 A1 Aug. 13, 2015

Related U.S. Application Data

(60) Provisional application No. 61/930,418, filed on Jan. 22, 2014.

(51) Int. Cl.

| | |
|---|---|
| ***A63H 3/28*** | (2006.01) |
| ***A63H 33/26*** | (2006.01) |
| ***A63H 3/00*** | (2006.01) |
| ***A63H 3/36*** | (2006.01) |

(52) U.S. Cl.

CPC ..... *A63H 33/26* (2013.01); *A63H 3/003* (2013.01); *A63H 3/006* (2013.01); *A63H 3/28* (2013.01); *A63H 3/36* (2013.01)

(58) Field of Classification Search

USPC ... 446/71, 72, 175, 219, 297, 302, 369, 484; 434/304

See application file for complete search history.

(56) References Cited

U.S. PATENT DOCUMENTS

| | | | | |
|---|---|---|---|---|
| 5,114,376 | A * | 5/1992 | Copley et al. | 446/369 |
| 5,279,514 | A * | 1/1994 | Lacombe et al. | 446/297 |
| 5,738,526 | A * | 4/1998 | Cerda et al. | 434/304 |
| 5,791,965 | A * | 8/1998 | Kim | 446/219 |
| 6,000,987 | A * | 12/1999 | Belin et al. | 446/175 |
| 6,165,037 | A * | 12/2000 | Van Zant | 446/219 |
| 6,188,311 | B1 * | 2/2001 | Rothschild | 340/309.7 |
| 6,447,359 | B1 * | 9/2002 | Crump | 446/100 |
| 6,502,060 | B1 * | 12/2002 | Christian | 702/178 |
| 6,692,330 | B1 * | 2/2004 | Kulick | 446/297 |
| 6,997,772 | B2 * | 2/2006 | Fong | 446/175 |
| 7,338,340 | B2 * | 3/2008 | Poesch | 446/297 |
| 8,873,343 | B2 * | 10/2014 | Higgins | G04G 11/00 368/109 |

(Continued)

*Primary Examiner* — Kurt Fernstrom
(74) *Attorney, Agent, or Firm* — Jenei LLC

(57) ABSTRACT

A bed toy has doll body that contains a device for indicating when a child should stay in bed or may get up. One or more lights are attached to the doll body and are exteriorly visible. A wireless communication interface contained in the doll body to wirelessly link to a personal access network. An application is executed by a remote user device to transmit one of a time setting, a wake-up time, a light enablement command, over the personal access network to the wireless communication interface. A light driver selectively illuminates the lights to produce change of illumination. A utility executed by a processor determines that a timing event has occurred based upon the time setting and the current time and commands a light driver to change illumination selected from one of no light, a first color and a second color in response to the timing event.

8 Claims, 3 Drawing Sheets

(56) References Cited

U.S. PATENT DOCUMENTS

| | | | | |
|---|---|---|---|---|
| 2008/0192580 | A1* | 8/2008 | Larian | 368/10 |
| 2008/0194175 | A1* | 8/2008 | Last et al. | 446/302 |
| 2009/0079561 | A1* | 3/2009 | Nelson | 340/540 |
| 2009/0105524 | A1* | 4/2009 | Bressler et al. | 600/27 |
| 2010/0203490 | A1* | 8/2010 | Hocherman | 434/304 |
| 2013/0280985 | A1* | 10/2013 | Klein | 446/297 |
| 2014/0198623 | A1* | 7/2014 | Hill | 368/10 |

* cited by examiner

BED TOY AND SLEEP TIME INDICATOR

CROSS-REFERENCE TO RELATED APPLICATIONS

This application claims the benefit of priority under 35 U.S.C. §119(e) to U.S. Patent Application Provisional Application Ser. No. 61/930,418 entitled "Bed Toy and Sleep Time Indicator," filed Jan. 22, 2014, the contents of which are hereby incorporated by reference in their entirety.

BACKGROUND OF THE INVENTION

1. Field of the Invention

The present application pertains to a child's bed toy, and more particularly to a toy containing an alarm clock that provides an indication of when to remain in bed that is intuitively understandable to the very young.

2. Description of the Related Art

Parents of a young child are often challenged during sleep time. Having a bed toy to sleep with may comfort the child. Night-lights may also provide a sense of security from an otherwise dark room. However, the child before learning how to tell time still may not know when he should be in bed.

SUMMARY OF THE INVENTION

In one aspect, the present disclosure provides a toy apparatus having a plush toy body. One or more lights are attached to the plush toy body and are exteriorly visible. A user interface receives a time setting. A chronometer tracks a current time. A processor is in communication with the user interface to receive the time setting and in communication with the chronometer to receive the current time. A utility is executed by the processor to determine that a timing event has occurred based upon the time setting and the current time and to command a change of illumination selected from one of no light, a first color and a second color in response to the timing event. A light driver contained in the plush toy body is electrically connected to the one or more lights to selectively illuminate the one or more lights to produce change of illumination in response to command from the utility.

In another aspect consistent with the present disclosure, a bed toy includes doll body having one or more lights attached to the doll body and exteriorly visible. A wireless communication interface contained in the doll body is wirelessly linked to a personal access network. An application is executed by a remote user device to transmit one of a time setting, a wake-up time, a light enablement command, over the personal access network to the wireless communication interface. A chronometer tracks a current time. A light driver contained in the doll body is electrically connected to the one or more lights to selectively illuminate the one or more lights to produce change of illumination. A processor is in communication with the wireless communication interface, the chronometer, and the light driver. A utility is executed by the processor to determine that a timing event has occurred based upon the time setting and the current time and to command a change of illumination by the light driver selected from one of no light, a first color and a second color in response to the timing event.

In another aspect consistent with the present disclosure, a method provides for instructing a child with a bed toy when to remain in bed for sleeping. The method includes receiving a time setting of one of a wake-up time setting and a nap duration setting; receiving a user input to start a sleep cycle; illuminating one or more lights contained by a doll body of the bed toll to selectively illuminate a first one of two or more colors indicating sleep time in response to receiving the user input to start the sleep cycle; determining that a time event has occurred based upon the time setting indicating one of a wake-up time and expiration of a nap; and illuminating the one or more light contained by the doll body to selectively illuminate a second one of the two or more colors in response to the time event.

These and other features are explained more fully in the embodiments illustrated below. It should be understood that in general the features of one embodiment also may be used in combination with features of another embodiment and that the embodiments are not intended to limit the scope of the invention.

BRIEF DESCRIPTION OF THE DRAWINGS

The various exemplary embodiments of the present invention, which will become more apparent as the description proceeds, are described in the following detailed description in conjunction with the accompanying drawings, in which.

DETAILED DESCRIPTION

Figure 1:
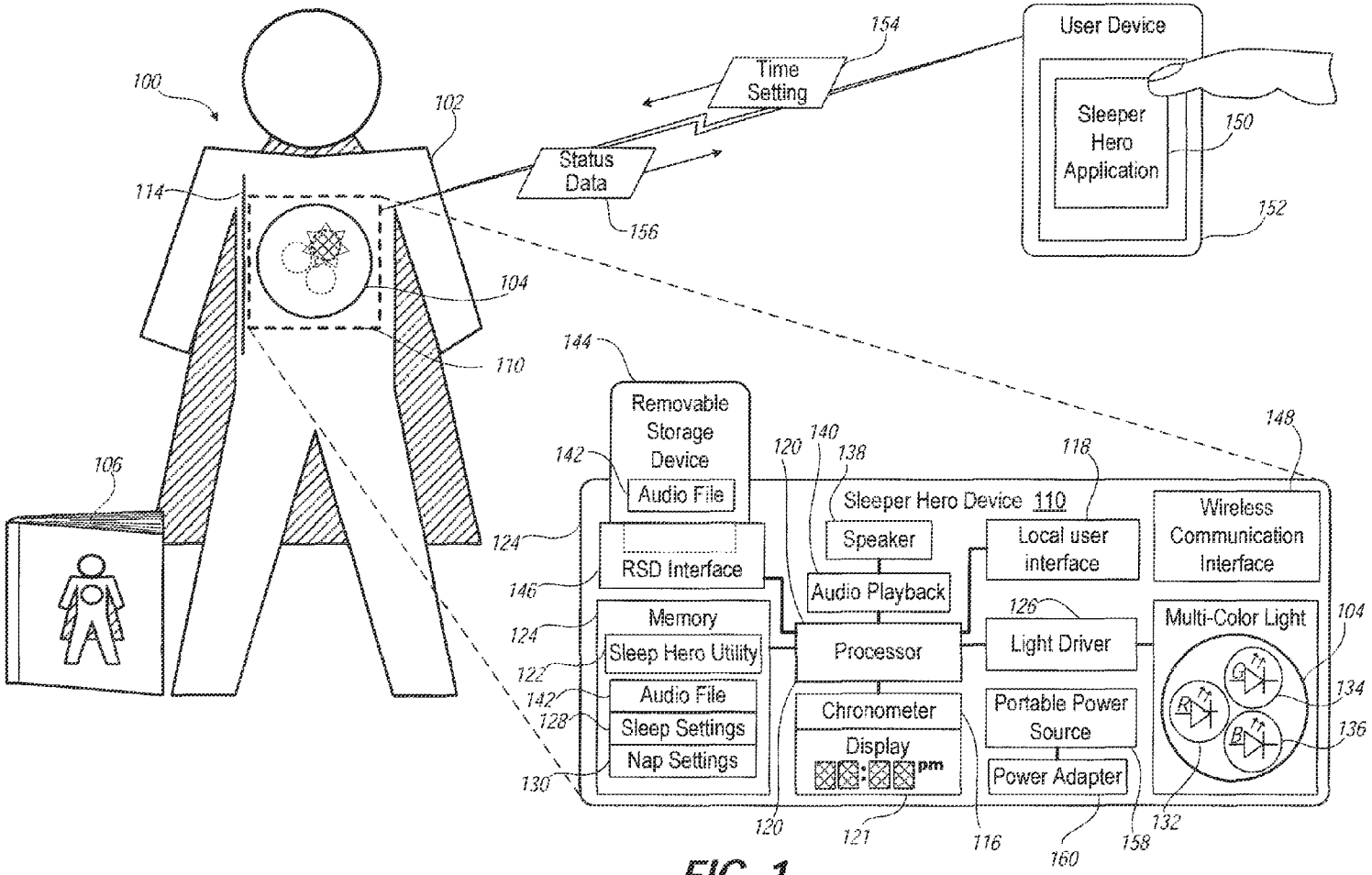
FIG. 1 illustrates a block diagram of a toy apparatus having a plush toy body containing a device for time-based color illuminations to signal times to be in bed and to be out of bed, according to one embodiment.

SLEEPERHERO™ bed toy is intended for young children wherein a timed color changing light on its chest guides troubled sleepers to know when it is okay to get out of bed in the morning. In one embodiment, the bed toy has a plush toy body containing a timed device in its interior that changes a light visible on the toy's chest from red to green based off of an allotted time a parent adjusts to their personal preferences. There is a digital clock that tells the current time. The user can set a sleep time so the light is red and the child knows he or she is supposed to stay in their bed. The user can set the wake time so the light will turn green and the child knows he or she is allowed to get out of bed. There is an on/off switch so the lights can be turned off but the clock will still function. The bed toy addresses the concern of a child's fear of staying in bed all night and a parent's issue with trying to keep the child in his/her bed all night. In one embodiment, SLEEPERHERO™ bed toy is unique because it is a superhero toy that the child can cuddle with in bed to help alleviate fears and also aide in keeping the child in bed with the basic red to green changing lights. An illustrated storybook may accompany the doll. It could be in the form of print and/or electronic format, or another format.

In one exemplary embodiment, the storybook is an electronic book comprising audio and/or video content stored in memory within the device such as contained in memory device 124. The audio and/or video content can be received by engaging removable memory. Alternatively, audio and/or video content can be received through a wired interface. Alternatively, audio and/or video content can be received wirelessly from an access network (e.g., wireless local access network, wireless wide area network, cellular, Bluetooth, personal access network, near field communication, etc.). In one embodiment, memory that contains the audio and/or video content, contains an amount of digital storage volume to hold copies of digital data. This storage may take the form of, but is not limited to, flash memory or hard disk drive. The user may attach one end of a digital data transfer cable to the memory, and the other end of the data transfer cable to another external device such as a computer, telephone or camera. The user then chooses the digital files to be transferred from the external device to the storage medium of memory, and then the user initiates said transfer. The digital audio and/or video content files will contain representations of the audio, images, videos, text, pictographs or sequence of computer instructions. After completion of the digital data transfer, the user will disconnect the external data transfer cable from memory.

In one embodiment, a display is provided that is configured to be capable of storing or generating video data in a format that the video data can be communicated to, or accessed by, the emitter; the video source, therefore, is also configured to be capable of transmitting video data. For example, the video source can be a personal media player having memory for storing video data. By way of other examples, the video source can a digital video camera configured to capture (e.g., live video capture (but not store on a medium such as a tape)) and/or record video data; or a portable hard drive. In the embodiment shown, the video source is coupled to the emitter by way of source cable, and the source cable is a patch cable having 2.5 mm (ear phone) plugs (for connecting to the video source and emitter). In other embodiments, the source cable can be any suitable cable for communicating video data, and can include one or more wires or discrete communication paths. For example, the source cable can include any one or more of: an RCA audio or video cable, an HDMI cable, a USB cable, a fiber optic cable, or the like. In some embodiments, the video source and the emitter can be a single unit, such as, for example, a cellular phone configured to be capable of: storing or generating video data, and transmitting wirelessly video data to a receiver within the device, e.g., via Bluetooth, Wi-Fi, infrared link, or the like. Display cable can similarly be any suitable cable configured to be capable of communicating video data (including audio sounds) from the receiver to display. In embodiments in which a display cable is used, the display cable may include a power source for the device if the same is not provided in the receiver; the display cable may include an on/off switch that, when toggled to "on," allows video data (including images and sound) to reach the device; and may include a volume controller for the sound data that is transmitted to the device. The functions the display cable performs can be integrated into receiver in other embodiments. Additional options include a microphone for audio input and earphones for audio output via wireless or wired communications. In another embodiment, the plush toy may also include the ability to produce light, vibration or other sound effects In an exemplary embodiment the plush toy body may be a doll having the likeness of a human person of either sex or may not be sex-specific. The human person may be aesthetically constructed to appear, as is any ethnicity. The plush toy body may also have the likeness of an animal. The plush toy body may be a doll that is soft and can be taken to bed with the child and cuddled.

The light may present on the chest, or be visible through the outer material of the doll. In an exemplary aspect, the light changes from red to green to inform the child of when it is an acceptable time to get out of bed. The light may have two colored bulbs—one red and one green. Alternatively, the light may have any number of bulbs for greater intensity or color variation. The light could change from a range of different colors. The light may include one or more Light Emitting Diode (LED) lights of plastic/PVC material or other materials/fabrics. The light(s) could also be located on alternate areas of the doll. The light could go to sleep mode and return to light when the outer portion of the light is tapped.

The electronics may be located in a plastic container inside the doll, and accessed from the back of the doll. For example, this container may include two (2) AA batteries, but could also include different types and number of batteries. The container has a digital timer that an adult can manipulate to set their preference. There is an on/off switch, a nap switch and a lock mode. The timer could also be a dial or an alternate version of a timer. The electronics could be housed in a computer chip. The light could also be solar powered, or powered by natural energy. In place of batteries, the doll could get its power from a power charger that plugs into an outlet.

An application may enable an adult to control the timing of the light feature remotely. The application may also control sound. For example a Universal Serial Bus (USB) device may be included so that the adult can directly share audio or other files with the doll. A sound feature may be synchronized with any change of the light. The sound could be a designated sound and/or music or a recorded sound. The sounds/music could be controlled wirelessly.

Turning to the drawings, FIG. 1 illustrates a bed toy 100 having a body 102 suitable for a child to hold in bed. For example, the body 102 may be plush. The body 102 may also resemble a doll. For clarity, the body 102 resembles a human wearing a cap, although it should be appreciated that other shapes may be selected. One or more lights 104 are attached to the body 102. For example, one light 104 may be capable of emitting two or more colors of illumination. Alternatively first one or a first subset of the lights 104 are illuminated in order to emit one color and a second one or a second subset of the lights 104 are illuminated in order to emit a second color. For example, the first color may indicate time to sleep and the second color may indicate time to get out of bed. The bed toy 100 may be accompanied by a storybook 106 about the bed toy 100 that serves as an entertaining way to instruct a child about how to use the bed toy 100.

In one embodiment, the functional components of bed toy 100 are constructed as a sleeper hero device 110 contained in a housing 112 that is inserted into the body 102 through a Velcro opening 114. The device 110 may include a chronometer 116 to track a current time. In one embodiment, a local user interface 118 on the housing 112 receives a time setting. A processor 120 of the device 110 in communication with the local user interface 118 to receive the time setting and in communication with the chronometer 116 to receive the current time. A local display 121 may be viewed by a user, either visible externally to the bed toy 100 as assembled or after removal of the sleeper hero device 110 from the Velcro opening 114.

A sleep hero utility 122 in memory device 124 is executed by the processor 120 to determine that a timing event has occurred based upon the time setting and the current time. The utility 122 commands a change of illumination of the one or more lights 104 selected from one of no light, a first color and a second color in response to the timing event. A light driver 126 that is contained in the housing 102 is electrically connected to the one or more lights 104 to selectively illuminate the one or more lights 104 to produce change of illumination in response to command from the utility 122. The timing event may be based on sleep settings 128 or nap settings 130 contained in memory device 124.

In one embodiment, the one or more lights 104 include Light Emitting Diodes (LED) such as a red LED 132, a green LED 134, and a blue LED 136. Activating one, two or three of the LEDs 132, 134, 136 to varying relative intensities can create a range of colors.

In one embodiment, the bed toy 100 also plays audio sounds. To that end, the sleeper hero device 110 includes an audio speaker 138 driven by an audio playback device 140. The memory device 124 may be provisioned with an audio file 142 for the utility 122 to command playback by the audio playback device 140 over the audio speaker 138 in response to the timing event. Alternatively, the audio file 140 may be accessed on a removable storage device (RSD) 144 inserted into an RSD interface 146 (e.g., USB).

Alternatively to, or in addition to local controls via the local user interface 118, the sleeper hero device 110 may also include a wireless communication interface 148 for Personal Access Network (PAN) protocols such as BLUETOOTH. An application 150 executed by a remote user communication device 152 transmits a time setting 154 over the personal access network to the wireless communication interface 148. The application 150 transmits one of a light enablement command, an audio enablement command, an audio file, a current time of day update, a nap duration setting, and a nap start timer command. The bed toy 100 may respond with status data 156. The device 110 may be powered by a portable power source 158 (e.g., battery). Alternatively or in addition, a power adaptor 160 may receive external power.

Figure 2:
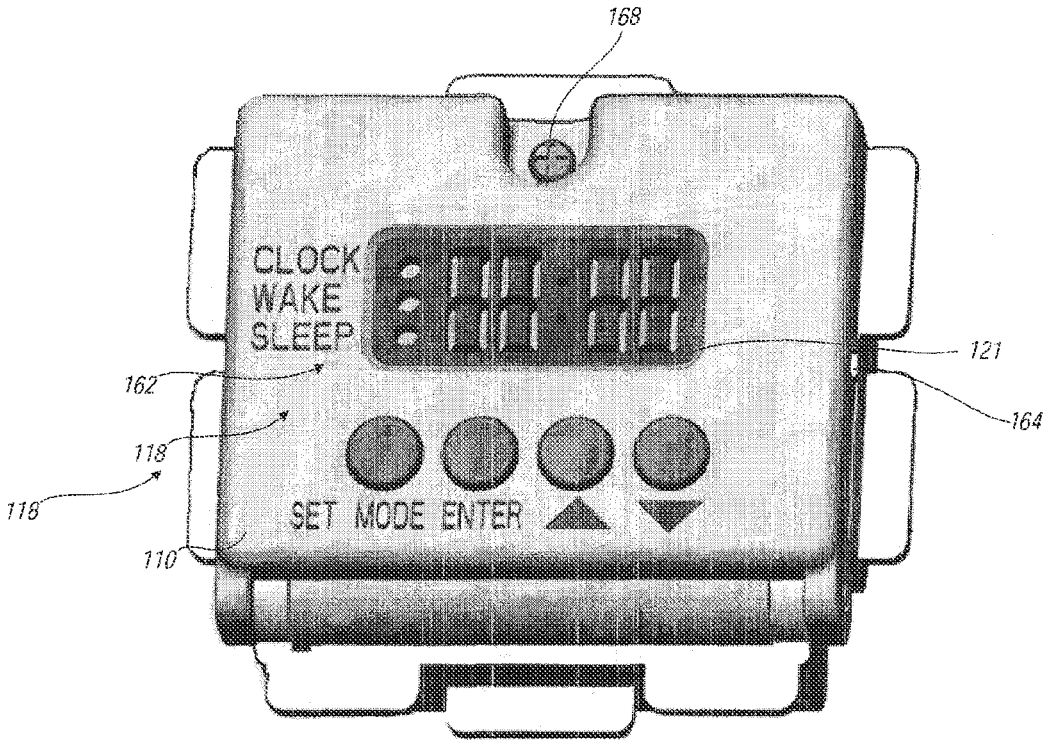
FIG. 2 illustrates a rear isometric view of the device removed from the plush toy body for local user input, according to one embodiment.

FIG. 2 illustrates the local user interface 118; including clock controls 162 and on/off switch 164, and local display 121 of the sleeper hero device 110. A battery compartment lid 166 is held by a machine screw 168.

Figure 3:
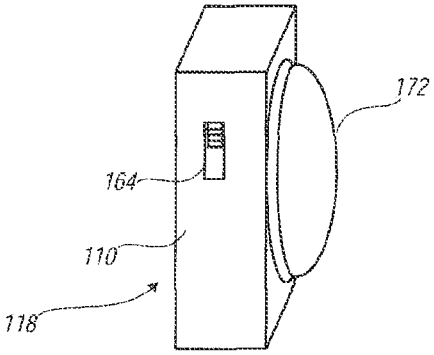
FIG. 3 illustrates a right isometric view of the device showing a selectively illuminated multi-color light device, according to one embodiment.

FIG. 3 illustrates the sleeper hero device 110 from a right side, showing a light dome 172 that may also serve as a touch sensitive device as part of the local user interface 118.

Figure 4:
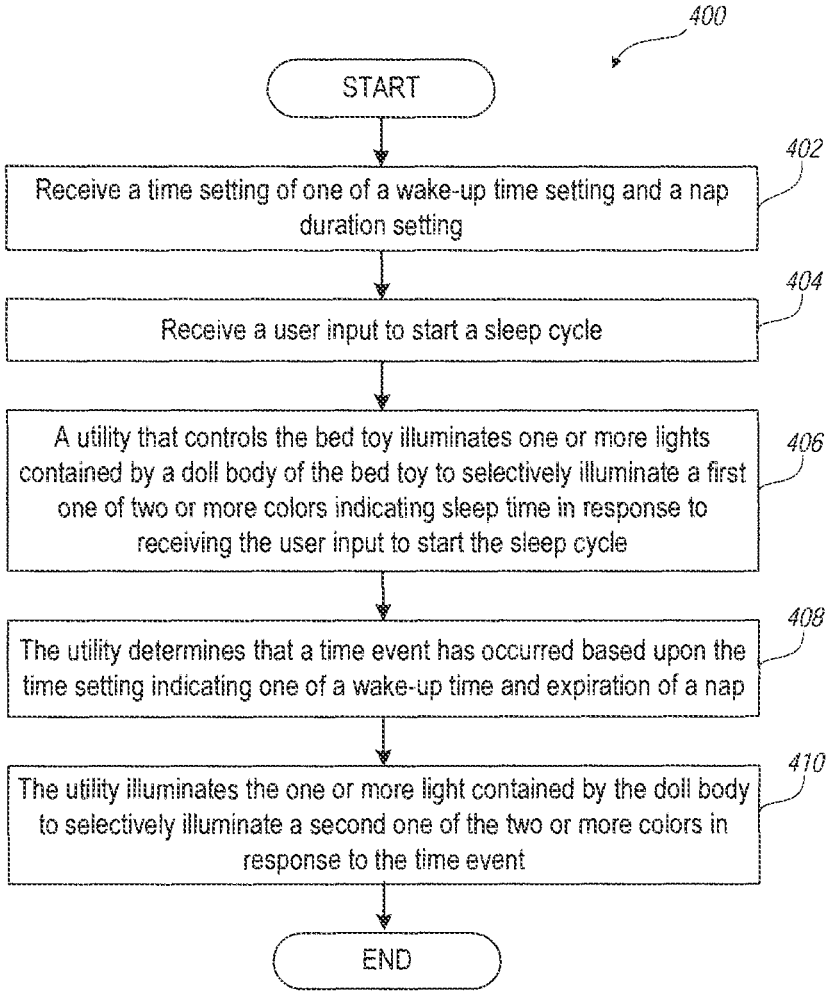
FIG. 4 illustrates a flow diagram of a method for selectively activating colors of illumination from a plush toy apparatus to inform a child of when to be in bed, according to one embodiment.

FIG. 4 illustrates a method 400 for instructing a child with a bed toy when to remain in bed for sleeping. The method 400 includes receiving a time setting of one of a wake-up time setting and a nap duration setting (block 402). In block 404, the method 400 further includes receiving a user input to start a sleep cycle. A utility that controls the bed toy illuminates one or more lights contained by a doll body of the bed toll to selectively illuminate a first one of two or more colors indicating sleep time in response to receiving the user input to start the sleep cycle (block 406). In block 408, the utility determines that a time event has occurred based upon the time setting indicating one of a wake-up time and expiration of a nap. In block 410, the utility illuminates the one or more light contained by the doll body to selectively illuminate a second one of the two or more colors in response to the time event. Then method 400 ends.

In one embodiment, the method 400 further includes accessing an audio file; and playing the audio file over a speaker contained in the doll body in response to the time event. In an exemplary embodiment, the method 400 further includes accessing the audio file on a removable storage device inserted into a removable storage device interface contained in the doll body.

In one embodiment, the method 400 further includes wirelessly connecting to a personal access network; and receiving the user input via the personal access network from an application executed on a user communication device. In an exemplary embodiment, the method 400 further includes wirelessly receiving a command from the user communication device; determining that the command indicates a state change for the bed toll from one of disabling the one or more lights, enabling the one or more lights, and starting nap time; and performing the determined state change.

In the above-described flow chart, one or more of the methods may be embodied in a computer readable device containing computer readable code such that a series of functional processes are performed when the computer readable code is executed on a computing device. In some implementations, certain steps of the methods are combined, performed simultaneously or in a different order, or perhaps omitted, without deviating from the scope of the disclosure. Thus, while the method blocks are described and illustrated in a particular sequence, use of a specific sequence of functional processes represented by the blocks is not meant to imply any limitations on the disclosure. Changes may be made with regards to the sequence of processes without departing from the scope of the present disclosure. Use of a particular sequence is therefore, not to be taken in a limiting sense, and the scope of the present disclosure is defined only by the appended claims.

Aspects of the present disclosure are described above with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. Computer program code for carrying out operations for aspects of the present disclosure may be written in any combination of one or more programming languages, including an object oriented programming language, without limitation. These computer program instructions may be provided to a processor of a general purpose computer, special purpose computer, such as a service processor, or other programmable data processing apparatus to produce a machine, such that the instructions, which execute via the processor of the computer or other programmable data processing apparatus, performs the method for implementing the functions/acts specified in the flowchart and/or block diagram block or blocks.

All publications, patents and patent applications cited herein, whether supra or infra, are hereby incorporated by reference in their entirety to the same extent as if each individual publication, patent or patent application was specifically and individually indicated as incorporated by reference. It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein, will only be incorporated to the extent that no conflict arises between that incorporated material and the existing disclosure material.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

While it is apparent that the illustrative embodiments of the invention herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present invention.

What is claimed is:

1. A toy apparatus, comprising:

a plush toy body comprising an opening in an outer material to access an interior cavity; and a device comprising:

a housing that is inserted in the body through the opening;

one or more lights that are one of: (i) attached to the housing and exteriorly visible through the outer material of the body and (ii) present on the plush toy body and exteriorly visible;

a local user interface on the housing to receive a time setting, the local user interface comprising a local display viewable to a user as visible externally after removal from the body;

a chronometer contained in the housing to track a current time;

a processor contained in the housing and in communication with the local user interface to receive the time setting and in communication with the chronometer to receive the current time;

a utility executed by the processor to determine that a timing event has occurred based upon the time setting and the current time and to command a change of illumination selected from one of no light, a first color and a second color in response to the timing event; and a light driver contained in the housing and electrically connected to the one or more lights to selectively illuminate the one or more lights to produce change of illumination in response to command from the utility.

2. The toy apparatus of claim 1, further comprising:

an audio speaker;

an audio playback device in electrical communication with the audio speaker; and a memory device containing an audio file, wherein the utility is further to command playback of the audio file by the audio playback device over the audio speaker in response to the timing event, and the audio speaker, audio playback device and memory device are contained in the housing.

3. The toy apparatus of claim 2, further comprising:

a removable storage device interface in communication with the processor, wherein the processor is further to access the audio file stored on a removable storage device that is in communication with the removable storage device interface.

4. The toy apparatus of claim 1, further comprising:

a wireless communication interface contained in the toy plush body to wirelessly link to a personal access network; and an application executed by a remote user device to transmit the time setting over the personal access network to the wireless communication interface.

5. The toy apparatus of claim 4, wherein the application is further to selectively transmit one of a light enablement command, an audio enablement command, an audio file, a current time of day update, a nap duration setting, and a nap start timer command.

6. The toy apparatus of claim 1, wherein the timing event is one of a time of day and a nap duration timer.

7. The toy apparatus of claim 1, further comprising a local control that comprises a light dome having a tough sensitive device, wherein the local control includes a go to sleep mode and return to light when the outer portion of the light is tapped.

8. The toy apparatus of claim 1, wherein the one or more lights are visible through the outer material of the body.

* * * * *